US008800225B1

(12) United States Patent
Brown

(10) Patent No.: US 8,800,225 B1
(45) Date of Patent: Aug. 12, 2014

(54) TOWER FOUNDATION

(71) Applicant: Franklin Brown, Clarkesville, GA (US)

(72) Inventor: Franklin Brown, Clarkesville, GA (US)

( * ) Notice: Subject to any disclaimer, the term of this patent is extended or adjusted under 35 U.S.C. 154(b) by 0 days.

(21) Appl. No.: 13/786,033

(22) Filed: Mar. 5, 2013

Related U.S. Application Data

(63) Continuation-in-part of application No. 13/757,400, filed on Feb. 1, 2013.

(51) Int. Cl.
*E02D 27/32* (2006.01)
*E02D 27/42* (2006.01)

(52) U.S. Cl.
USPC ..... 52/295; 52/292; 52/294; 52/296; 52/297; 52/298

(58) Field of Classification Search
USPC ..... 52/292, 294, 295, 296, 297, 298
See application file for complete search history.

(56) References Cited

U.S. PATENT DOCUMENTS

| | | | | | |
|---|---|---|---|---|---|
| 2,374,624 | A * | 4/1945 | Schwendt | ..... | 52/223.5 |
| 4,672,782 | A * | 6/1987 | Richter et al. | ..... | 52/218 |
| 5,231,808 | A * | 8/1993 | Angelette | ..... | 52/122.1 |
| 5,257,489 | A * | 11/1993 | Angelette | ..... | 52/295 |
| 5,533,835 | A * | 7/1996 | Angelette | ..... | 405/229 |
| 5,746,036 | A * | 5/1998 | Angelette | ..... | 52/295 |
| 7,533,505 | B2 * | 5/2009 | Henderson | ..... | 52/292 |
| 7,618,217 | B2 * | 11/2009 | Henderson | ..... | 405/255 |
| 7,827,748 | B2 | 11/2010 | Brown | | |

* cited by examiner

*Primary Examiner* — Mark Wendell
(74) *Attorney, Agent, or Firm* — Baker Donelson; Dorian B. Kennedy

(57) ABSTRACT

A tower foundation (10) has a base slab (11), pillar slabs (12), and a crown stab (13), all of which are made of precast concrete structures. The slabs are all retained in position by steel guide rods (15) that extend upwardly from the base slab. The guide rods have externally threaded ends (16) configured to receive internally threaded mounting nuts (17). The crown slab has guide rod mounting holes (22) through which the guide rods extend. The crown slab has a central passageway (18) with two semi-circular ancillary channels (19) which include an incoming conduit channel (20) and an outgoing conduit channel (21). The incoming conduit channel receives the incoming electrical conduit (24) while the outgoing conduit channel (21) receives the outgoing electrical conduit (24').

6 Claims, 2 Drawing Sheets

TOWER FOUNDATION

REFERENCE TO RELATED APPLICATION

This is a continuation-in-part of U.S. patent application Ser. No. 13/757,400 filed Feb. 1, 2013.

TECHNICAL FIELD

This invention relates to foundation slabs, and particularly to foundations made of precast concrete slabs.

BACKGROUND OF THE INVENTION

Today there exists a vast number of towers, such as cellular telephone towers, railroad communication tower utilizing microwave, radio and satellite communications, and tilt-down towers, being erected across the country. Each tower includes a foundation embedded within the ground which prevents the tower for toppling over.

In the past, these foundations have been constructed by merely digging a hole in the ground and filling the hole with concrete to which the upright towers is anchored. This has been costly in that it requires that mixed concrete in fluid form be transported to each site, requires a curing time to pass before the next step of the process can be complete, thereby slowing the construction process and increasing costs, and requires a time or inspection delay between construction events which can cause days of delays to occur.

More recently, foundations have been made of a series of precast concrete components. The precast concrete components include large slabs with holes therethrough through which guide rods extend that coupled the slabs together. A problem with these slabs has been that the guide rods tend to move slightly or vibrate with the passage of nearby trains or other vehicles or due to environmental forces upon the tower such as wind and rain. This movement can cause the guide rods to chip or wear against the hole. Additionally, the bolts threaded onto the top's of the guide rods and against the slab may also wear upon the concrete surface, thereby causing a loosening of the bolt on the guide rod and against the concrete slab.

Another problem associated with precast tower foundations is that they include a large central passageway through the crown slab that does not always align with a space within the lower slabs. As such, electrical conduits associated with the equipment mounted to the tower coupled to the foundation are not always easily passed through the crown slab or are compressed between the foundation slabs.

Accordingly, it is seen that a precast tower foundation crown slab that overcomes or alleviates the just described problems is needed. It is to the provision of such therefore that the present invention is primarily directed.

SUMMARY OF THE INVENTION

A tower foundation comprises a concrete base slab, at least one pillar slab having a plurality of legs defining leg spaces between adjacent pairs of legs, a concrete crown slab having a vertical, central passageway, a vertical incoming conduit ancillary channel extending from the central passageway and oriented above one leg space, and a vertical outgoing conduit ancillary channel extending from the central passageway and oriented above another leg space, a plurality of guide rods extending through the base slab, pillar slab, and crown slab, and a plurality of guide rod nuts, each nut being threaded upon one guide rod.

DETAILED DESCRIPTION

Figure 1:
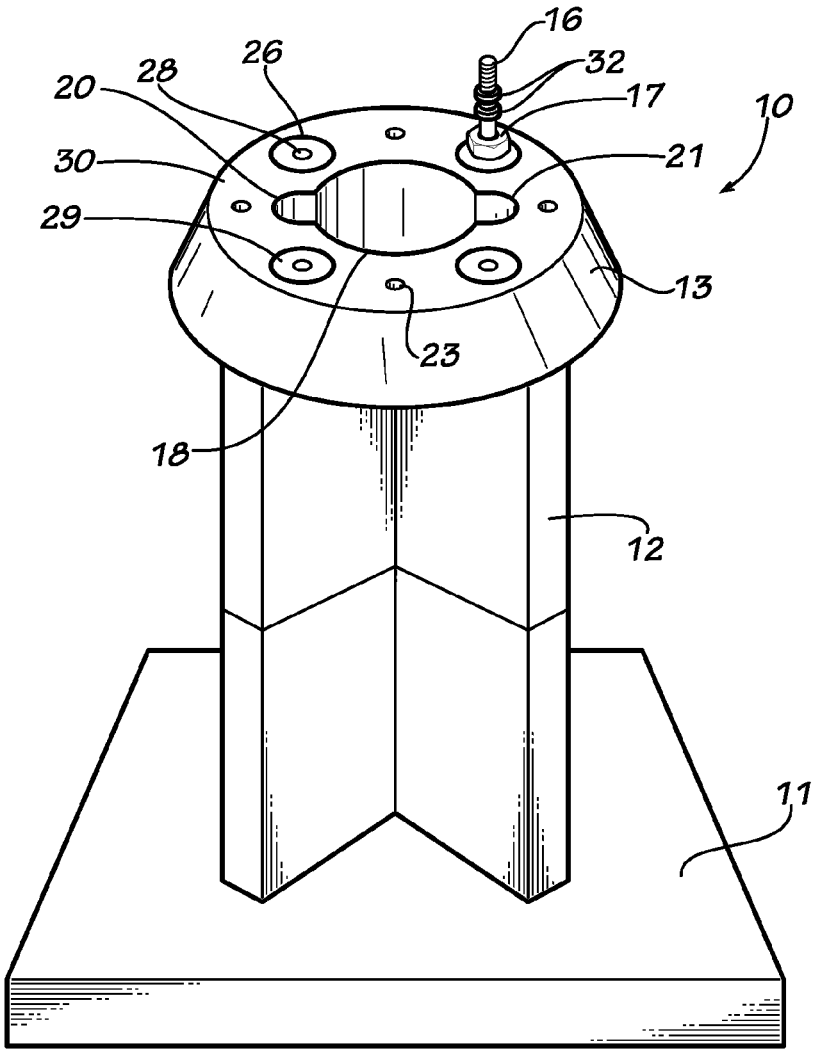
FIG. 1 is a perspective view of a tower foundation embodying principles of the invention in a preferred form.
Figure 4:
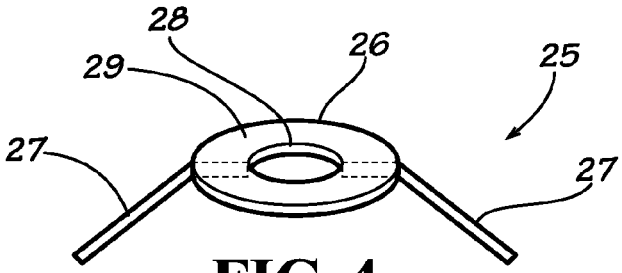
FIG. 4 is a perspective view of the compression washer assembly of the tower foundation of FIG. 1.
Figure 2:
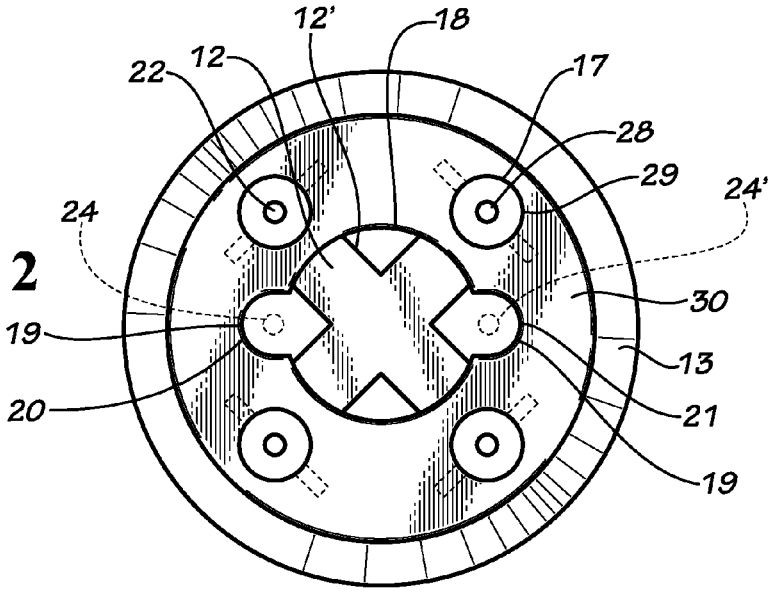
FIG. 2 is a top view of the crown slab of the foundation of FIG. 1.
Figure 3:
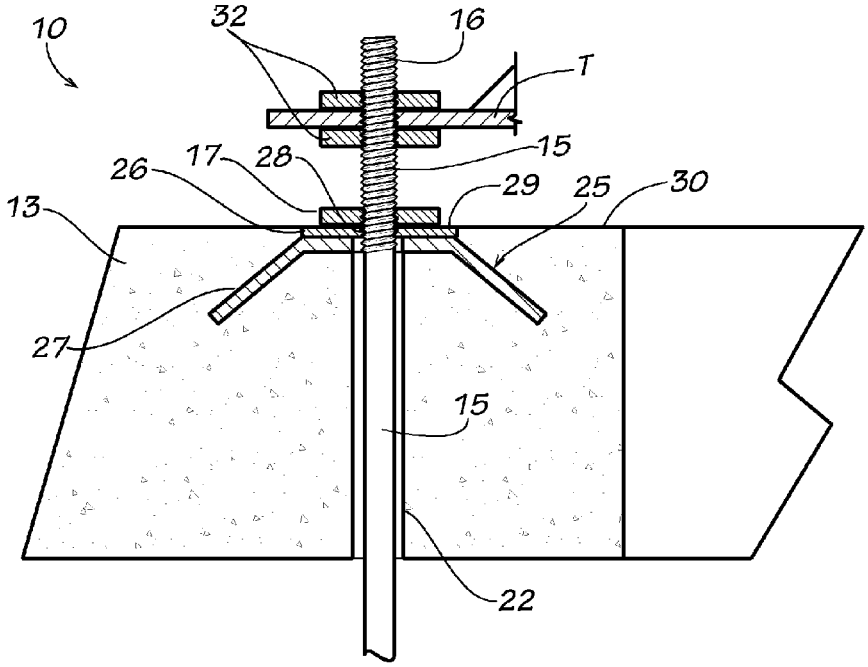
FIG. 3 is a cross-sectional view of the crown slab of a portion of the foundation of FIG. 1.

With reference next to the drawing, there is shown a tower foundation 10 of the present invention in a preferred form. The foundation here has a base or bottom slab 11, a plurality of pillar or middle slabs 12, and a crown or top stab 13, all of which are made of precast concrete structures. The base slab 11, pillar slabs 12 and crown slab 13 are all retained in position by four steel guide rods 15 that extend upwardly from the base slab 11. The four guide rods 15 have externally threaded ends 16 configured to receive internally threaded mounting nuts 17. The guide rods 15 are arranged in a generally square pattern.

The base slab 11, pillar slabs 12 and crown slab 13 are manufactured in molds shown and described in detail in U.S. Pat. No. 5,257,489, which is specifically incorporated herein. The molds have side wall surfaces that are tapered which results in the slabs sides being tapered.

Once made, the base slab 11 is of an extremely strong and rigid construction. It also has four guide rod mounting holes that extend down to four anchor plates to which guide rods 15 are mounted. The four guide rods 15 are then mounted to the base slab 11.

The two pillar slabs 12 are generally X-shaped (four legs 12') and rest upon the base slab 11. The pillar slabs 12 have four guide rod mounting holes extending therethrough positioned to be aligned with the guide rods 15. The pillar slabs 12 are mounted on the four guide rods 15 atop the base slab 11.

Finally, the crown slab 13 is mounted atop the pillar slabs 12. The concrete crown slab 13 has a body portion with four guide rod mounting holes 22 extending therethrough through which the guide rods 15 extend. The crown slab also includes four unshown eye bolts extending from eye bolt mounting holes 23 and embedded inserts within the top surface. The crown slab 13 has a generally circular central passageway 18 with two oppositely disposed, semi-circular cut-outs or ancillary channels 19 extending outwardly therefrom. The ancillary channels 19 are designated an incoming conduit ancillary channel 20 and an outgoing conduit ancillary channel 21, the actual designation of which being an incoming or an outgoing is immaterial to the invention. The incoming conduit ancillary channel 20 receives the incoming electrical conduit 24 associated with electrical wiring going to (coupled to the input of) the electrical components of the tower, while the outgoing conduit ancillary channel 21 receives the outgoing electrical conduit 24' associated with electrical wiring coming from (coupled to the output of) the electrical components of the tower. It should be noted that the ancillary channels 19 are oriented to be directly over the space between adjacent legs 12' of the X-shaped pillars, so that the electrical conduits 24 and 24' extend between the legs 12' of the X-shaped pillars (within the space between adjacent legs 12') and into the ancillary channels. Thus, the ancillary channels prevent the conduits from becoming pinched, crushed or chaffed between or against adjacent slabs.

The crown slab 13 also has four compression washer assemblies 25 partially embedded therein. Each compression washer assembly 25 includes a metal pressure plate, main plate, or washer 26 and a pair of oppositely disposed mounting or anchor legs 27 mounted to the pressure washer 26. The pressure washer 26 has a central mounting hole 28 coaxially aligned with the crown slab guide rod mounting holes 22 through which the guide rod extends. The pressure washer 26 has a top surface 29 which is positioned generally coplanar or flush with the top surface 30 of the crown slab and therefore exposed from the top. The anchor legs 27 are embedded within the crown slab to provide reinforcement and stability.

With this construction, the slabs 11, 12 and 13 are assembled with the guide rods extending through each slab's mounting holes and extending past the top surface 30 of the crown slab 13. This construction allows the weight of the tower to be dissipated through the pressure washer 26 and into the rest of the foundation, rather than being loaded upon the guide rods and solely to the base of the foundation. The threaded mounting nuts 17 are then threaded onto the rods to a position wherein they are in direct contact with and bear tightly against the top surface 29 of the pressure washer 26. As such, the mounting nuts 20 bear against a solid metal plate like structure. Thus, the mounting nut no longer bears against concrete which is susceptible to chipping or wearing due to vibrations or other types of movement. The elimination of the concrete wearing problem enables the nut 20 to be better secured and the tower foundation to be more rigid and therefore safer in initial construction as well as over an extended period of time.

The threaded top ends 16 of the guide rods extend past the top surface 30 of the crown slab 13. A tower T, or the like, is then coupled to the top end 16 and secured in place on each rod by a pair of tower mounting nuts 32. The relative positions of the tower mounting nuts 32 along the guide rod 15 may be adjusted to level the tower.

The pillar slabs here are generally rectangular in shape. The foundation of FIG. 1 has a base slab 11 that measure four feet by four feet and a height of six inches. Once the foundation is placed in the ground and the dirt is packed tightly around the foundation the dirt is pressed tightly against the sidewalls of the pillar slabs.

Typically, the foundation of FIG. 1 is used to support cellular towers or the like, but may be used for any type of tower, signage, signal or other device. As such, the term tower foundation is not meant to be a limitation, but merely a description of one use of structure used in conjunction with the foundation.

It should be understood that any number and peripheral shape of pillar slabs may be utilized with the present invention, the number and size of slabs depends on the size and weight of the slabs and on the size, height and weight of the tower coupled thereto. Also, it should be understood that the base and crown slabs may also be configured to having tapered sidewalls.

It should be understood that while the preferred embodiment described the pressure washer top surface as being mounted "flush" with the top surface of the crown slab, slight variations should be included in the term "flush". As such, the term "flush" should also include slight or small variations between these two top surfaces and should not be construed strictly as exactly coplanar.

It thus is seen that a tower foundation is now provided that overcomes problems long associated with those of the prior art. It should be understood however that many modifications, additions and deletions may be made to the embodiments specifically described without departing from the spirit and scope of the invention as set forth in the following claims.

The invention claimed is:

1. A tower foundation crown slab comprising a concrete body portion having a top surface, a bottom surface opposite said top surface, a plurality of guide rod mounting holes extending between said bottom surface and said top surface adapted to receive a plurality of threaded guide rods each being adapted to receive a threaded guide rod nut thereon, a central passageway vertically extending through said concrete body portion between said top surface and said bottom surface, a vertically extending incoming conduit ancillary channel extending from said central passageway, and a vertically extending outgoing conduit ancillary channel extending from said central passageway.

2. The tower foundation slab of claim 1 wherein said incoming conduit ancillary channel and said outgoing conduit ancillary channel are oppositely disposed from each other across said central passageway.

3. A tower foundation comprising:

a concrete base slab having a plurality of guide rod mounting holes, at least one X-shaped concrete pillar slab having a four legs each having a guide rod mounting holes;

a concrete crown slab having a plurality of guide rod mounting holes, a central passageway extending vertically therethrough, a vertically oriented incoming conduit ancillary channel extending outwardly from said central passageway, and a vertically oriented outgoing conduit ancillary channel extending outwardly from said central passageway;

a plurality of guide rods, each said guide rod extending through one said base slab guide rod mounting hole, one said pillar slab guide rod mounting hole, one said crown slab guide rod mounting hole, and a plurality of guide rod nuts, each guide rod nut being threaded upon one said guide rod.

4. The tower foundation slab of claim 3 wherein said incoming conduit ancillary channel and said outgoing conduit ancillary channel are oppositely disposed from each other across said central passageway.

5. A tower foundation comprising:

a concrete base slab, at least one pillar slab having a plurality of legs defining leg spaces between adjacent pairs of said legs;

a concrete crown slab having a vertical, central passageway, a vertical first conduit ancillary channel extending from said central passageway and oriented above one said leg space, and a vertical second conduit ancillary channel extending from said central passageway and oriented above one said leg space;

a plurality of guide rods extending through one said base slab, said pillar slab, and said crown slab, and a plurality of guide rod nuts, each guide rod nut being threaded upon one said guide rod.

6. The tower foundation slab of claim 5 wherein said first conduit ancillary channel and said second conduit ancillary channel are oppositely disposed from each other across said central passageway.

* * * * *